US011460256B2

(12) United States Patent
Zielinski et al.

(10) Patent No.: US 11,460,256 B2
(45) Date of Patent: Oct. 4, 2022

(54) HEAT EXCHANGER HEADER

(71) Applicant: Modine Manufacturing Company, Racine, WI (US)

(72) Inventors: Simon Zielinski, Wheeling, IL (US); Matthew Hernigle, Greenfield, WI (US); James Prochniak, Racine, WI (US); John Kis, Kansasville, WI (US); Peter Kottal, Mount Pleasant, WI (US); Vivek Shetty, Kenosha, WI (US); David Caucutt, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 226 days.

(21) Appl. No.: 16/308,995

(22) PCT Filed: Jun. 21, 2017

(86) PCT No.: PCT/US2017/038480

§ 371 (c)(1),
(2) Date: Dec. 11, 2018

(87) PCT Pub. No.: WO2017/223166

PCT Pub. Date: Dec. 28, 2017

(65) Prior Publication Data

US 2019/0316852 A1 Oct. 17, 2019

Related U.S. Application Data

(60) Provisional application No. 62/353,618, filed on Jun. 23, 2016.

(51) Int. Cl.
*F28F 9/00* (2006.01)
*F28F 9/02* (2006.01)
(Continued)

(52) U.S. Cl.
CPC ..... *F28F 9/0243* (2013.01); *F28D 1/05391* (2013.01); *F28F 9/002* (2013.01);
(Continued)

(58) Field of Classification Search
CPC ..... F28F 9/0243; F28F 9/002; F28F 9/0224; F28F 9/0248; F28F 21/084;
(Continued)

(56) References Cited

U.S. PATENT DOCUMENTS 3,368,617 A 2/1968 Malek et al.
4,026,456 A * 5/1977 Lema ..... B23K 1/0012 228/136

(Continued)

FOREIGN PATENT DOCUMENTS

CN 102128557 A 7/2011
DE 10150213 A1 5/2003

(Continued)

OTHER PUBLICATIONS

Notification of First Office Action for Application No. 201810642839.3, China National Intellectual Property Administration, dated Dec. 4, 2019 (9 pages).

(Continued)

*Primary Examiner* — Travis Ruby
(74) *Attorney, Agent, or Firm* — Michael Best & Friedrich LLP

(57) ABSTRACT

A header for a heat exchanger includes a first and a second cylindrical fluid manifold extending in parallel. Each of the first and second manifolds have tube slots that extend through an arcuate wall section of the manifold. A thickened wall section of the header having a generally triangular wall section is bounded by the first and second fluid manifolds and by a planar outer surface of the header. An aperture extends through the thickened wall section to provide a fluid (Continued)

communication pathway between the first and second cylindrical fluid manifolds.

19 Claims, 5 Drawing Sheets

(51) Int. Cl.
*F28D 1/053* (2006.01)
*F28F 21/08* (2006.01)

(52) U.S. Cl.
CPC ..... *F28F 9/0224* (2013.01); *F28F 9/0248* (2013.01); *F28F 21/084* (2013.01); *F28F 2220/00* (2013.01); *F28F 2255/16* (2013.01); *F28F 2275/04* (2013.01)

(58) Field of Classification Search
CPC ..... F28F 2220/00; F28F 2255/16; F28F 2275/04; F28D 1/05391
See application file for complete search history.

(56) References Cited

U.S. PATENT DOCUMENTS 4,121,656 A * 10/1978 Huber ..... F28F 9/0212 165/110
4,569,390 A * 2/1986 Knowlton ..... F28D 1/05366 165/149
4,679,289 A 7/1987 Miller
4,829,780 A 5/1989 Hughes et al.
4,998,580 A * 3/1991 Guntly ..... F25B 39/02 165/133
5,009,262 A 4/1991 Halstead et al.
5,062,476 A 11/1991 Ryan et al.
5,088,193 A 2/1992 Okada et al.
5,163,507 A 11/1992 Joshi
5,179,853 A * 1/1993 Nicoletti ..... B21D 51/44 72/333
5,205,349 A * 4/1993 Nagao ..... B60H 1/00328 165/153
5,219,017 A 6/1993 Halstead et al.
5,228,512 A * 7/1993 Bretl ..... F28F 9/18 165/153
5,236,042 A * 8/1993 Kado ..... F28F 9/001 165/149
5,259,449 A 11/1993 Case
5,366,007 A 11/1994 Hutto et al.
5,535,819 A * 7/1996 Matsuura ..... F28F 9/0224 165/149
5,622,219 A * 4/1997 Voss ..... F25B 39/02 165/144
5,628,361 A * 5/1997 Getto ..... F28F 9/002 165/173
5,642,640 A 7/1997 Insalaco et al.
5,649,588 A * 7/1997 Lee ..... F28D 1/05375 165/153
5,737,952 A 4/1998 Baumann et al.
5,875,836 A 3/1999 Nakamura
5,941,303 A 8/1999 Gowan et al.
5,975,197 A * 11/1999 Kado ..... F28F 9/001 165/149
6,155,340 A 12/2000 Folkedal et al.
6,167,946 B1 * 1/2001 Uchikawa ..... F28F 9/002 123/41.14
6,216,776 B1 4/2001 Kobayashi et al.
6,289,979 B1 * 9/2001 Kato ..... F28F 9/0212 138/89
6,293,011 B1 * 9/2001 Hasegawa ..... B23K 1/0012 29/890.052
6,394,176 B1 5/2002 Marsais
6,622,783 B2 9/2003 Hitt et al.
6,725,517 B1 * 4/2004 Polvi ..... F27D 1/12 29/402.01
6,904,958 B2 6/2005 Ozaki et al.
6,929,059 B2 8/2005 Kim et al.
7,096,932 B2 8/2006 Scoville et al.
7,640,966 B2 1/2010 Maeda et al.
7,882,913 B2 2/2011 Maeda et al.
8,474,517 B2 * 7/2013 Borst ..... B21C 37/14 138/38
2001/0042611 A1 11/2001 Ozaki et al.
2003/0066633 A1 * 4/2003 Lee ..... F28D 1/0417 165/144
2003/0159813 A1 * 8/2003 Baldantoni ..... F28D 1/05375 165/140
2003/0226850 A1 * 12/2003 Hamida ..... F25B 39/04 220/890
2005/0188538 A1 * 9/2005 Kondo ..... B23P 11/02 29/890.044
2007/0209386 A1 * 9/2007 Higashiyama ..... F28F 17/005 62/515
2010/0025027 A1 * 2/2010 Borst ..... F28F 9/0214 165/173
2011/0174472 A1 7/2011 Kurochkin et al.
2013/0264039 A1 * 10/2013 Kis ..... F01P 1/00 165/173
2016/0003545 A1 1/2016 Taras et al.

FOREIGN PATENT DOCUMENTS

EP 0825404 A2 2/1998
EP 1657513 A1 5/2006
EP 2345861 A2 7/2011
KR 20090120078 A 11/2009

OTHER PUBLICATIONS

Notification of First Office Action for Application No. 201780039580.7, China National Intellectual Property Administration, dated Dec. 11, 2019 (9 pages).
Search Report and Search Opinion for Application No. 17816116.2, European Patent Office, dated Jan. 24, 2020 (7 pages).
First Examination Report for Application No. 201817048411, Intellectual Property India, dated Jan. 29, 2020 (6 pages).
International Search Report and Written Opinion for Application No. PCT/US2017/038480 dated Sep. 8, 2017 (7 pages).

* cited by examiner

FIG. 4
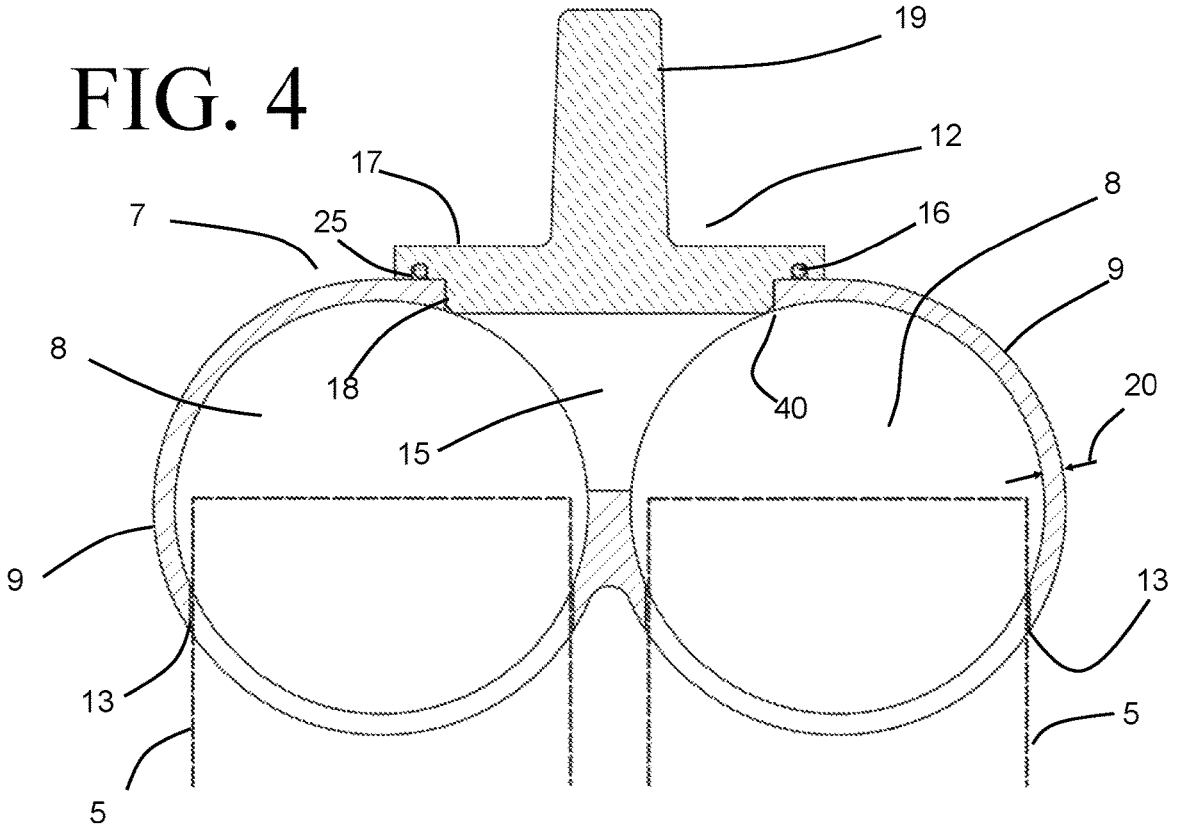
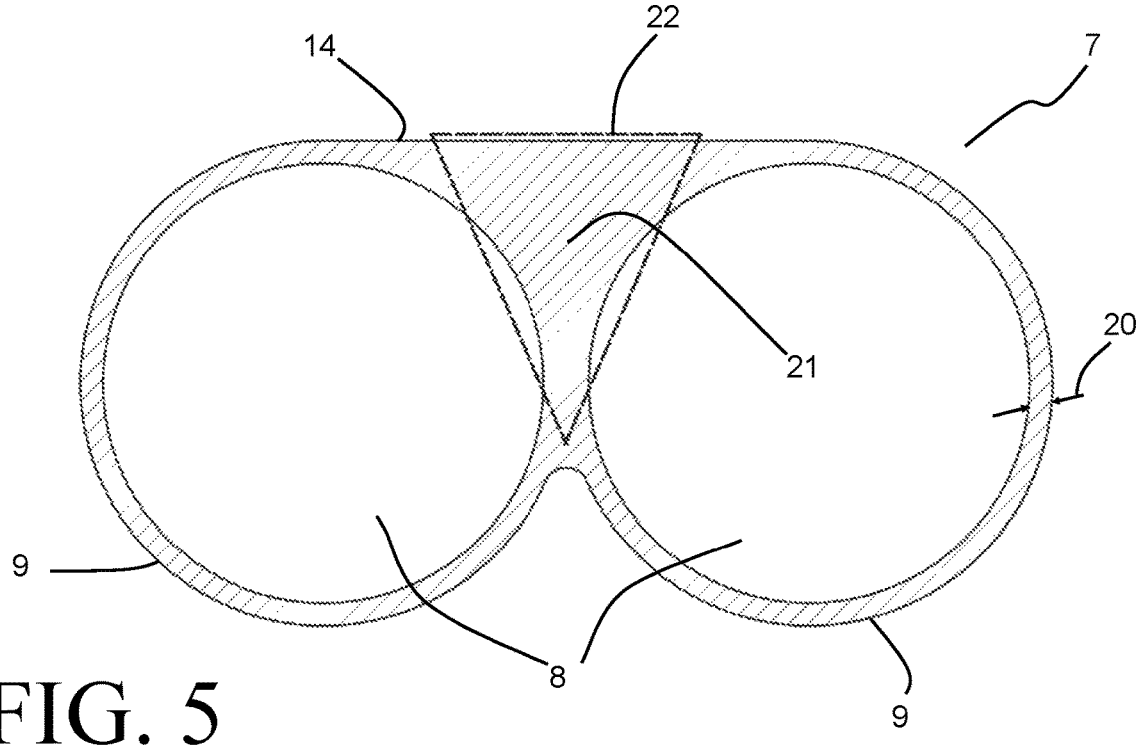
FIG. 5

HEAT EXCHANGER HEADER

CROSS-REFERENCE TO RELATED APPLICATIONS

This application claims priority to U.S. Provisional Patent Application No. 62/353,618 filed Jun. 23, 2016, the entire contents of which are hereby incorporated by reference herein.

BACKGROUND

Heat exchangers are used to transfer thermal energy from one stream of fluid at a first, higher temperature to another stream of fluid at a second, lower temperature. Oftentimes such heat exchangers are used to remove waste heat from a process fluid such as oil, coolant, or the like by transferring that heat to a flow of cooler air directed to pass through the heat exchanger.

In certain applications, the process fluid to be cooled is also at an operating pressure that is substantially greater than the ambient atmospheric pressure of the heat exchanger's surroundings. As a result, it becomes necessary for the heat exchanger to be designed to withstand the pressure forces that result from the process fluid passing through the heat exchanger. This can become challenging, especially in cases where the heat exchanger is to be used in large systems and machinery such as, for example, construction equipment, agricultural machines, and the like. As the size of the machine or system increases, the flow rate of the process fluid also increases, necessitating larger heat exchangers to accommodate both the heat transfer requirements and the fluid flow rates.

In some particular styles of heat exchangers, the fluid to be cooled is directed through an array of flat tubes extending between two tanks or headers. As such heat exchangers become larger, they can have substantially large surface areas exposed to the pressure of the process fluid, especially in the tank or header areas, and the force of the fluid pressure acting on these large surfaces can lead to destructive mechanical stresses in the heat exchanger structure. The ability to withstand such pressures can be improved through the use of circular header profiles, but circular headers can be difficult to package within a compact space as the required size of the heat exchanger increases.

SUMMARY

According to an embodiment of the invention, a header for a heat exchanger includes a first and a second cylindrical fluid manifold extending in parallel. Each of the first and second manifolds have tube slots that extend through an arcuate wall section of the manifold. A thickened wall section of the header having a generally triangular wall section is bounded by the first and second fluid manifolds and by a planar outer surface of the header. An aperture extends through the thickened wall section to provide a fluid communication pathway between the first and second cylindrical fluid manifolds.

In some embodiments, the header includes a plug that is inserted into an opening that extends through the planar outer surface to the aperture. In some such embodiments the plug is brazed to the planar outer surface. In some embodiments the plug includes an integral mounting pin that extends outwardly from the header in a direction perpendicular to the planar outer surface. In some embodiments the arcuate wall section of one of the manifolds defines a minimum wall thickness of the header, and the insertion depth of the plug through the opening is approximately equal to that minimum wall thickness.

In some embodiments the header includes a third cylindrical fluid manifold adjacent to and parallel to the second fluid manifold. A second thickened wall section of the header having a generally triangular wall section is bounded by the third and second fluid manifolds and by the planar outer surface of the header. In some such embodiments an aperture extends through the second thickened wall section to provide a fluid communication pathway between the second and third fluid manifolds.

In some embodiments the header includes a first and a second mounting flange extending from the header. The first mounting flange defines a first mounting plane and the second mounting flange defines a second mounting plane, with both the first and second mounting planes being oriented parallel to one another and perpendicular to the planar outer surface of the header. A first mounting hole extends through the first mounting flange and is aligned with a second mounting hole that extends through the second mounting flange. In some such embodiments all of the fluid manifolds are entirely located between the first and second mounting planes.

According to another embodiment, a method of making a header for a heat exchanger includes providing an extruded section with two unconnected cylindrical volumes arranged therein and with a planar outer surface, and machining through the planar outer surface to define an aperture between the two cylindrical volumes. The act of machining through the planar outer surface creates an opening in that surface, and a plug is inserted into the opening. In some embodiments the plug is brazed to the extruded section in order to secure it within the opening. In some embodiments a series of tube slots are formed into arcuate wall sections of the two cylindrical volumes opposite the planar outer surface.

BRIEF DESCRIPTION OF THE DRAWINGS

FIG. 4 is a plan cross-sectional view of the header of FIG. 3.

FIG. 5 is a plan cross-sectional view of a component of the header of FIG. 3.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
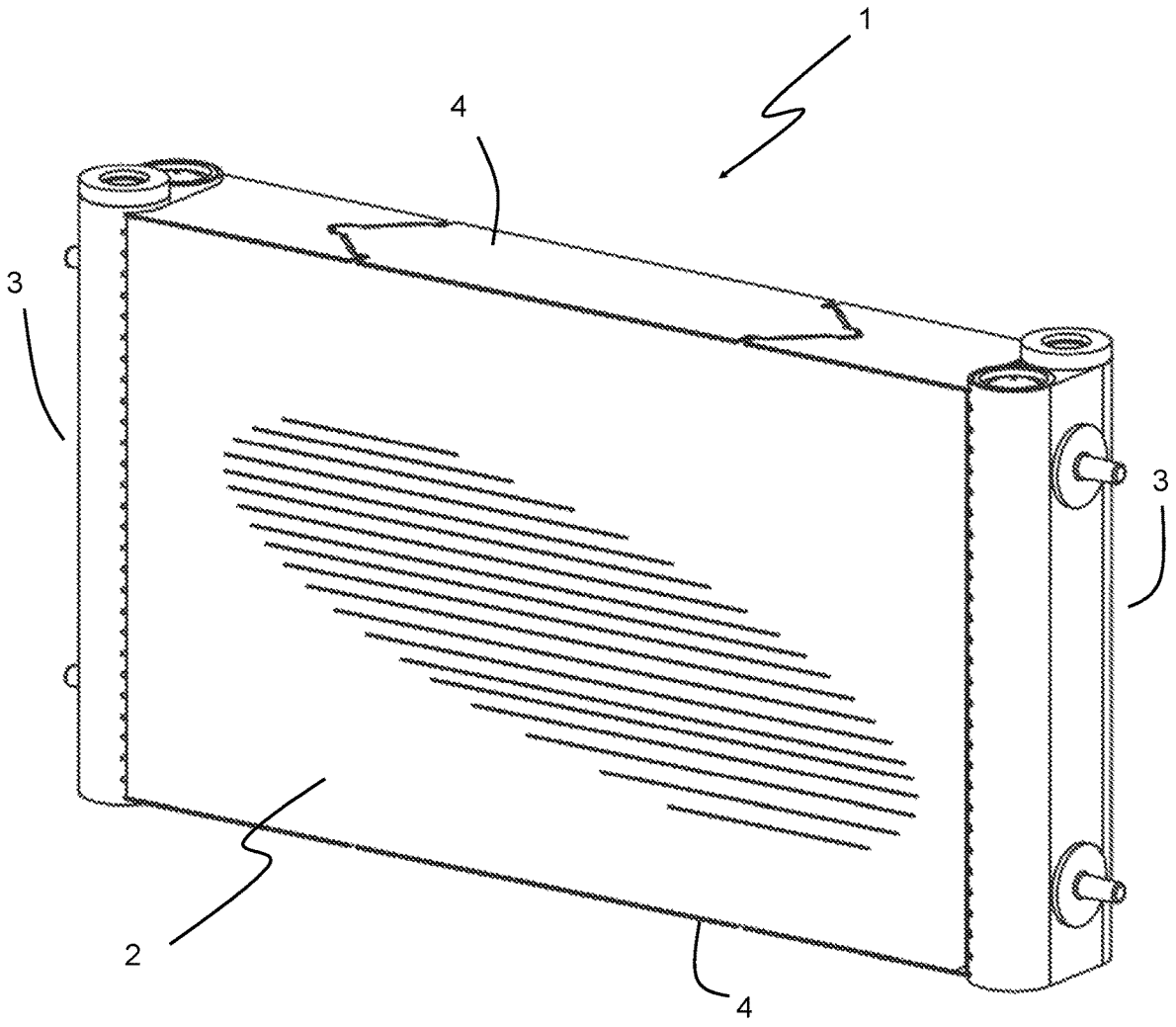
FIG. 1 is a perspective view of a heat exchanger including headers according to an embodiment of the invention.
Figure 2:
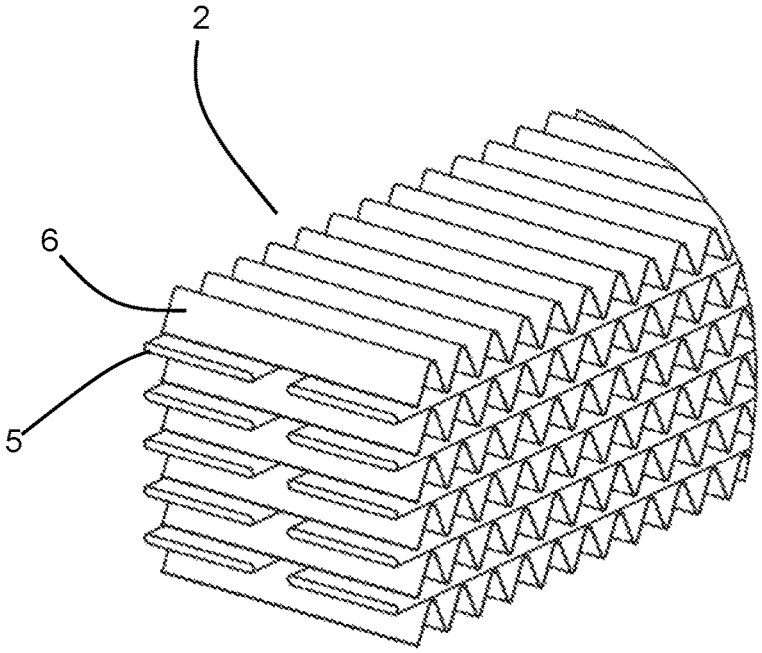
FIG. 2 is a partial perspective view of a section of a heat exchanger core used in the heat exchanger of FIG. 1.

A heat exchanger 1 according to an embodiment of the invention is depicted in FIG. 1, and includes a heat exchange core 2 bounded between two side plates 4. The heat exchange core 2 is constructed as a stacked and brazed assembly of alternating layers of flat tubes 5 and corrugated fins 6, as shown in the core detail of FIG. 2. The tubes 5 and fins 6 are preferably formed of an aluminum alloy so that the heat exchanger 1 can be built to be lightweight and highly efficient in the transfer of heat between a first fluid flowing through the interiors of the tubes 5 and a second fluid (air, for example) passing through the corrugations of the fins 6. Such a heat exchanger 1 can be used as, for example, a vehicular powertrain cooling heat exchanger to cool engine oil, transmission oil, engine coolant, or some other fluid from which dissipation of heat is desired.

Open ends of the tubes 5 are received into headers 3 arranged at opposing ends of the heat exchanger 1. Each header 3 is an assembly of parts, shown in exploded view in FIG. 3. The header 3 includes an extruded section 7 that extends over generally the full stacked height of the heat exchange core 2, and provides a number of cylindrical fluid manifolds 8 that distribute the first fluid to, or receive the first fluid from, the array of tubes 5. The number of cylindrical fluid manifolds 8 that is provided by each extruded section 7 corresponds to the number of tubes 5 provided in each row of tubes of the core 2 (e.g. two, in the exemplary embodiment of FIGS. 1-5).

As best seen in the cross-sectional view of FIG. 5, each of the cylindrical fluid manifolds 8 is bounded by an arcuate wall section 9 over a majority of the circular periphery of the manifold, with that arcuate wall section 9 having a generally constant wall thickness (indicated by the reference number 20). On the core-facing side of header 3, the arcuate wall sections 9 of the two adjacent manifolds 8 merge together. On the opposing (i.e. the non-core-facing) side of the header 3 a planar outer surface 14 of the header is provided. The planar outer surface 14, together with the cylindrical manifolds 8, bounds a thickened wall section 21 of the extruded section 7. The thickened wall section 21 has a generally triangular cross-section, as indicated in FIG. 5 by the dashed triangle 22), with a wall thickness that is substantially greater than the wall thickness 20 of the arcuate wall sections 9. As indicated by FIG. 5, the cross-section of the thickened wall section 21 can deviate somewhat from a truly triangular shape while still exhibiting a generally triangular cross-section.

Tube slots 13 are provided along the lengths of the headers 3 to receive the ends of the tubes 5 into the corresponding cylindrical fluid manifolds 8. The tube slots 13 can be formed into the extruded section 7 by, for example, saw-cutting or piercing. Each of the tube slots 13 extends through one of the arcuate wall sections 9, and has a width and height that generally corresponds to the major and minor dimensions of the flat tubes 5. The ends of the flat tubes 5 are preferably inserted into the tube slots 13 after the flat tubes 5 and the fins 6 have been stacked to form the core 2, so that the tubes 5 can be brazed to the headers 3 in the same brazing operation as is used to join the flat tubes 5 to the fins 6, thereby creating leak-free joints at the tube-to-header interfaces.

Figure 3:
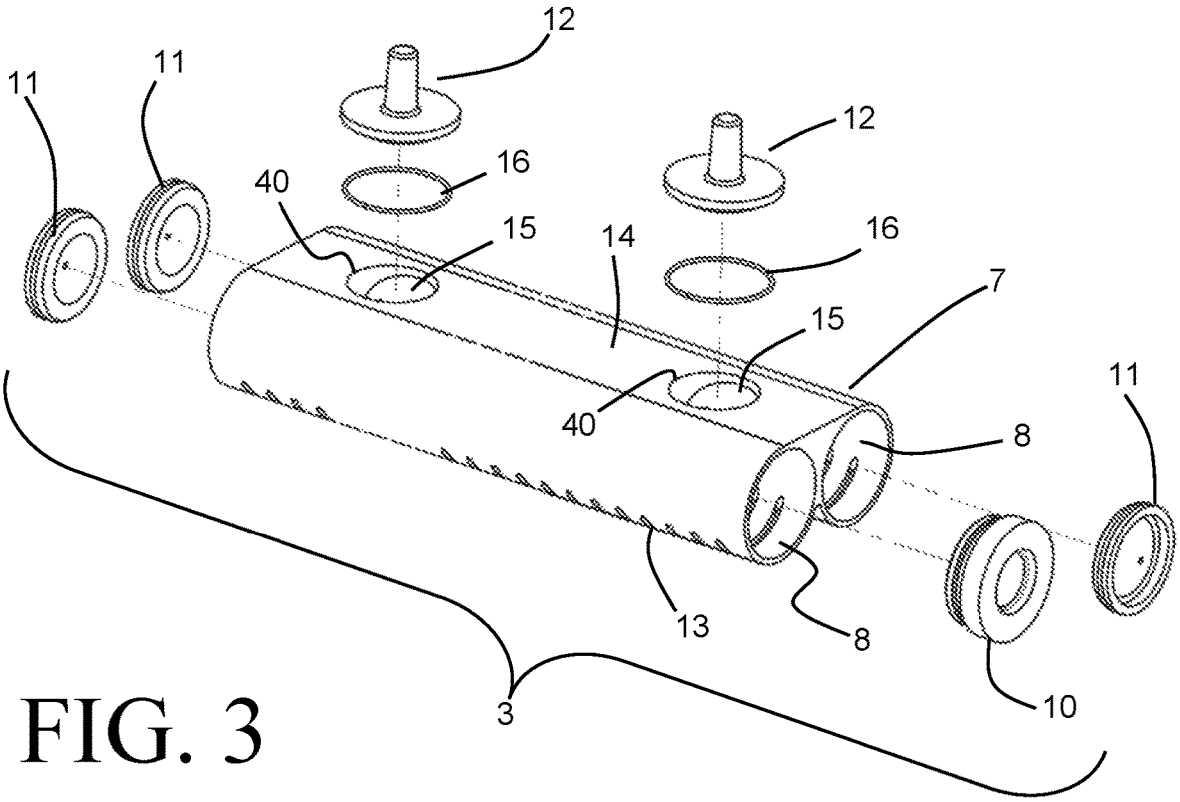
FIG. 3 is an exploded perspective view of one of the headers of FIG. 1.

The cylindrical fluid manifolds 8 are hydraulically connected by way of one or more apertures 15 that extend through the thickened wall section 21 at one or more locations along the length of the header 3. Such an aperture 15 can be formed by a machining operation such as drilling or milling through the planar surface 14 to a predetermined depth, in which case the forming of the aperture 15 can define a circular opening 40 in the planar surface 14, as shown in FIG. 3. The predetermined depth is selected to be less than the depth that would be required in order to remove all of the material separating the cylindrical fluid manifolds 8 at that location. As best seen in the cross-sectional view of FIG. 4, the aperture 15 of the exemplary embodiment has the material in the thickened wall section 21 removed to a depth, as measured from the planar surface 14, that is approximately equal to the radius of the arcuate wall sections 9. While the exemplary embodiment depicts a circular opening 40 formed in the planar outer surface 14, it should be understood that other machining methods might result in non-circular openings.

A plug 12 can be inserted into the opening 40 defined by the forming of the aperture 15 at the planar outer surface 14 in order to provide a fluid-tight seal between the fluid manifolds 8 and the outside environment external to the header 3. The plug 12 includes an insertion portion 18 with a profile that generally matches the opening 40 created in the planar surface 14, so that the plug 12 can be partially inserted into that opening 40 with minimal clearance between side surfaces of the insertion portion 18 and the opening 40. A peripheral flange portion 17 extends beyond the outer periphery of the insertion portion 18 by an amount sufficient to engage and bear upon the planar surface 14 surrounding the opening 40, thereby limiting the insertion depth of the plug 12. In some especially preferable embodiments, such as the exemplary embodiment of FIG. 4, the height of the insertion portion 18 (and, therefore, the depth of insertion of the plug 12 into the opening 40) is approximately equal to the wall thickness 20 of the arcuate wall sections 9.

A groove 25 can be provided in the face of the peripheral flange portion 17 that is disposed against the planar surface 14, and can be used to accommodate a ring of braze material 16. The plug 12, along with the ring of braze material 16, can be assembled to the extruded section 7 prior to brazing of the heat exchanger 1, so that the plug 12 can be secured into the header 3 during the brazing operation. In some embodiments it may be more preferable to instead use a braze foil, braze paste, or clad braze layer on either the plug 12 or the extruded section 7, in which case the braze ring 16 and the groove 25 may be eliminated.

One or more of the plugs 12 can be provided with an integral mounting pin 19 extending outwardly away from the header in a direction perpendicular to the planar outer surface 14. The integral mounting pins 19 can be accommodated into corresponding holes of other components to which the heat exchanger 1 is to be assembled in order to, for example, secure the heat exchanger 1 within a cooling module. Annular vibration isolators can be conveniently assembled over the mounting pin 19 and bear against the peripheral flange portion 17 of the plug 12.

At the ends of the header 3, the cylindrical fluid conduits 8 are sealed with either end caps 11 or fluid ports 10. In the exemplary embodiment of FIG. 1, each of the headers 3 is provided with three end caps 11 and one fluid port 10, so that the fluid to be cooled within the heat exchanger 1 can be received into one of the headers 3 (the inlet header) through its fluid port 10 and can be removed from the other one of the headers 3 (the outlet header) through its fluid port 10. Although the fluid is directly received into only one of the cylindrical fluid manifolds 8 of the inlet header 3, the apertures 15 provided in that header 3 allow at least some of the fluid to pass into the adjacent cylindrical fluid manifold 8 so that the flat tubes 5 connected to each of those fluid manifolds 8 are placed hydraulically in parallel with one another. In similar fashion, the fluid received into that one of the cylindrical fluid manifolds 8 of the outlet header 3 can be transferred by way of the apertures 15 into the cylindrical fluid manifold 8 having the outlet port 10.

By placing multiple fluid manifolds 8 in hydraulic parallel, the present invention is able to provide a more robust design for applications wherein the fluid to be cooled is at an elevated pressure. The ability of the fluid manifold to withstand the elevated internal pressures imposed by the fluid is increased by reducing the diameter of each fluid manifold, without sacrificing the total flow area provided by the flat tubes 5. To that end, it should be understood that the number of cylindrical fluid manifolds 8 that may be provided in each of the headers 3 is not limited to two. Additional fluid manifolds 8 can be provided, and can be fluidly connected to adjacent fluid manifolds through additional apertures 15. It should be understood that a multi-pass heat exchanger can also be provided by placing apertures 15 between some, but not all, of the adjacent fluid manifolds 8.

Figure 6:
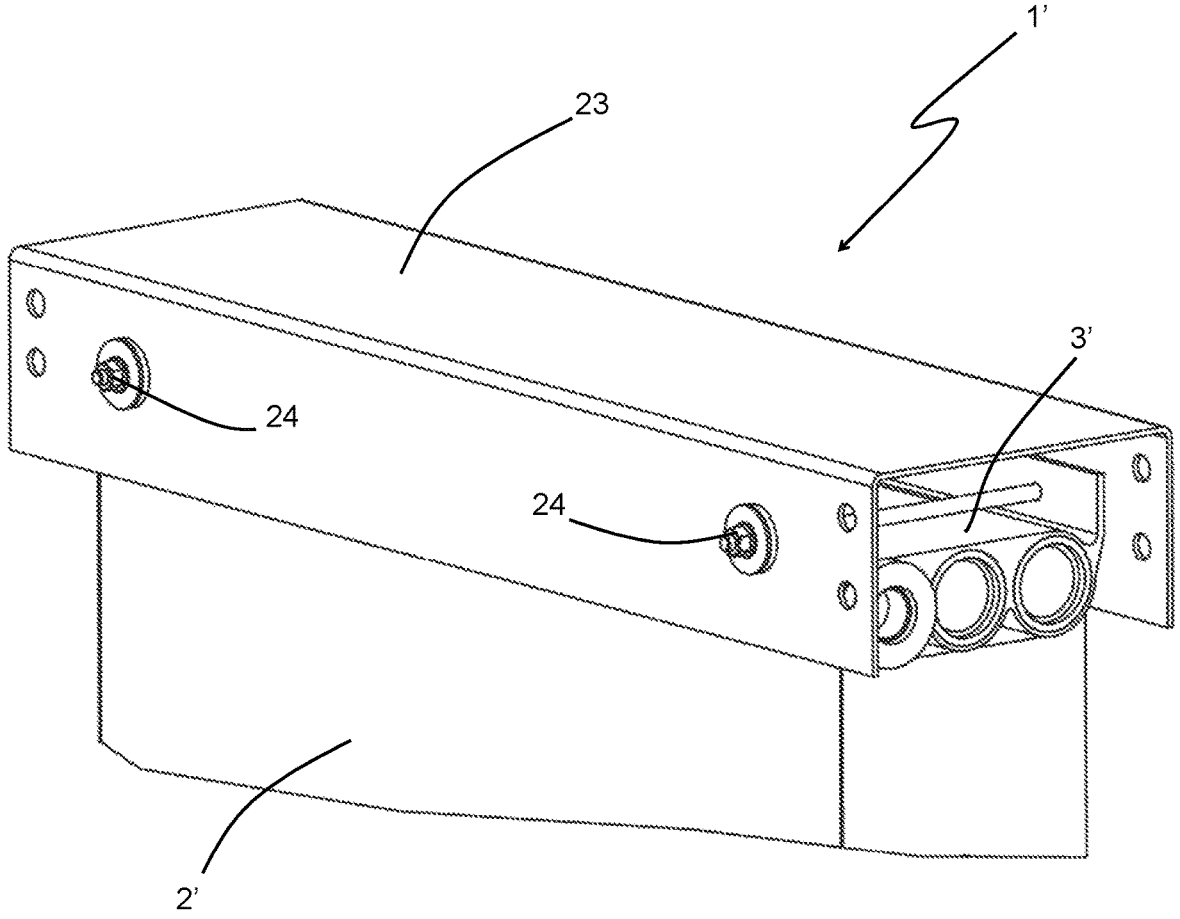
FIG. 6 is a partial perspective view of a heat exchanger including headers according to another embodiment of the invention.
Figure 7:
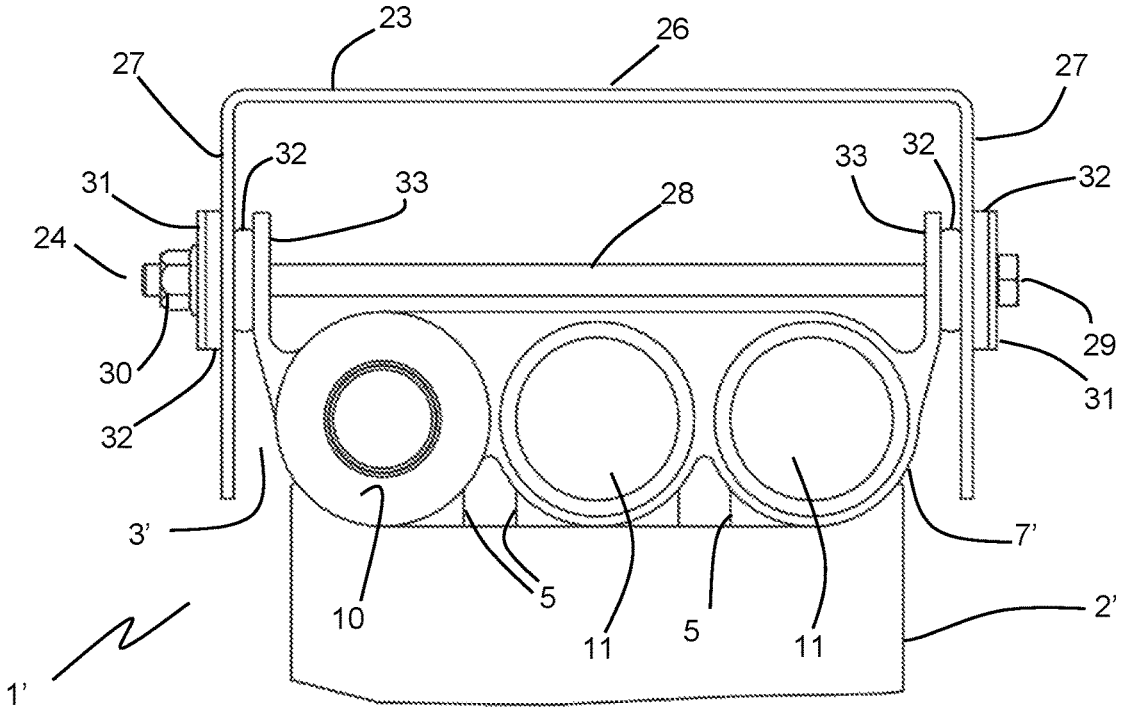
FIG. 7 is a partial plan view of the heat exchanger of FIG. 6.

As one non-limiting example of a heat exchanger having more than two cylindrical fluid manifolds within the headers, a portion of a heat exchanger 1' is depicted in FIGS. 6-7. The heat exchanger 1' includes a heat exchange core 2' that is substantially similar to the heat exchange core 2 depicted in FIG. 2, except that three rows of flat tubes 5 are provided in each layer of tubes. Similarly, a header 3' provided at either end of the core 2' (only a single header is shown) includes an extruded section 7' that includes three cylindrical fluid manifolds 8 arranged side-by-side to receive the ends of the tubes 5 in similar fashion as was described previously with reference to the embodiment of FIG. 1.

Figure 8:
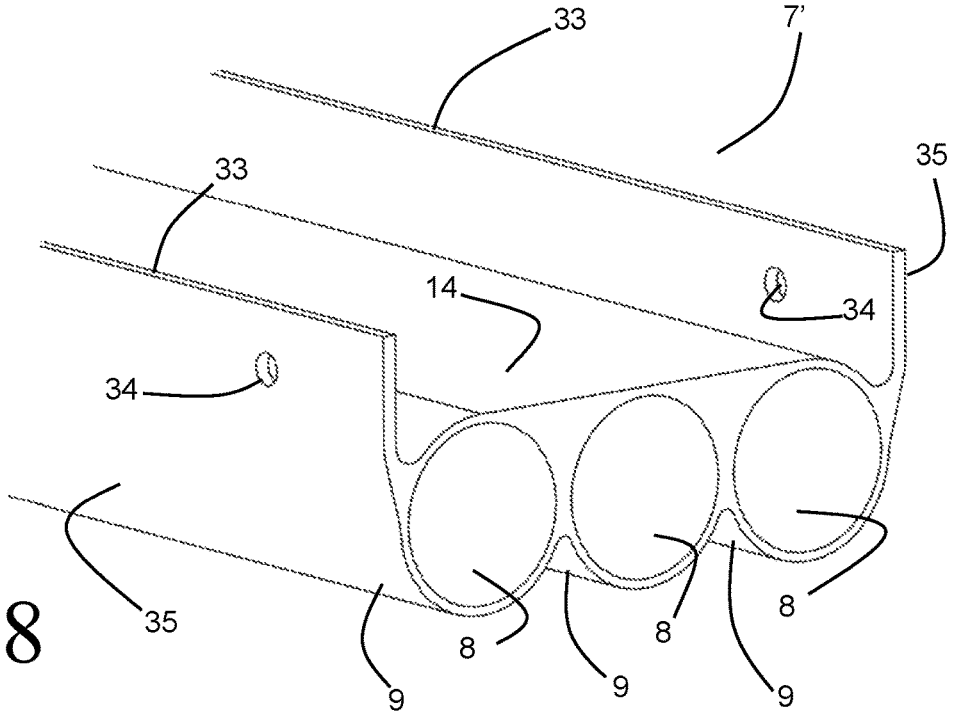
FIG. 8 is a partial plan view of a component of one of the headers of FIG. 6.

The extruded section 7', shown in greater detail in FIG. 8, is similar to the previously described extruded section 7 in that it includes an arcuate wall section 9 over a majority of the circular periphery of each manifold 8, with the arcuate wall sections 9 having a generally constant wall thickness. The ends of the tubes 5 are received into the fluid manifold through slots provided in those arcuate wall sections 9. A planar outer surface 14 is again provided on the opposing (i.e. the non-core-facing) side of the header 3'.

The extruded header section 7' can optionally be provided with mounting flanges 33, as shown in FIGS. 6-8. The mounting flanges 33 extend in a direction that is perpendicular to the planar surface 14 and is directed away from the heat exchange core 2, thereby defining a pair of mounting planes 35 (i.e. a first mounting plane 35 and a second mounting plane 35) for the heat exchanger 1' which are likewise arranged perpendicular to the planar surface 14. In some preferred embodiments the cylindrical fluid manifolds 8 provided by the header 3' are all located entirely between the pair of mounting planes 35. While the mounting flanges 33 are depicted as extending from the arcuate wall sections 9, it should be understood that they can alternatively or in addition extend from the planar surface 14.

The mounting flanges 33 can be used to structurally mount the heat exchanger 1' into a cooling module or other assembly, as shown in FIGS. 6-7. A U-channel 23 that forms part of the cooling module or other assembly includes parallel, spaced-apart legs 27 joined by a connecting section 26, with the space between the legs 27 sized to be sufficiently large to allow for the header 3' to be received there between. Connection assemblies 24 structurally connect the header 3' to the U-channel 23, and include compressible rubber isolators 32 that are inserted into holes placed within the U-channel 23 so that a portion of each isolator 32 is arranged inside of the U-channel 23 and another portion of the isolator 32 is arranged outside of the U-channel 23. The isolators 32 are provided in pairs at locations that align with corresponding mounting holes 34 provided in the flanges 33, so that a bolt 28 or other similar fastener can be inserted through the paired isolators 32 and the corresponding mounting holes 34 in the flanges 33. Washers 31 are provided between a head 29 of the bolt 28 and one of the paired isolators and between a nut 30 that is threaded onto the end of the bolt 28 and the other one of the paired isolators. Each of the connection assemblies thus includes a bolt 28, nut 30, pair of washers 31, and pair of isolators 32. By tightening the nuts 30 of the connection assemblies 24, the heat exchanger 1' can be secured to the U-channel 23. It should be understood that the connection assemblies 24 can be used either as an alternative to, or in addition to, the mounting pins 19 that were previously described.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A header for a heat exchanger, comprising:

a plurality of manifolds, each of the plurality of manifolds defined by an arcuate wall section on a tube side of the header, a planar outer surface opposite of the tube side in a first direction perpendicular to the planar outer surface, and a cylindrical inner surface;

a first cylindrical fluid manifold of the plurality of manifolds having a plurality of first tube slots extending through a first arcuate wall section of the arcuate wall section;

a second cylindrical fluid manifold of the plurality of manifolds extending parallel to the first cylindrical fluid manifold and having a plurality of second tube slots extending through a second arcuate wall section of the arcuate wall section;

a thickened wall section bounded by the first cylindrical fluid manifold, the second cylindrical fluid manifold, and the planar outer surface of the header, the thickened wall section having a generally triangular cross-section that extends in the first direction from the planar outer surface to an intersection of the first arcuate wall section and the second arcuate wall section, the thickened wall section being bounded by a first cylindrical inner surface of a first cylindrical manifold of the plurality of cylindrical manifolds and by a second cylindrical inner surface of a second cylindrical manifold of the plurality of cylindrical manifolds; and an aperture extending through the thickened wall section in a second direction perpendicular to the first direction from the first cylindrical inner surface to the second cylindrical surface, wherein the planar outer surface extends from the first cylindrical manifold to the second cylindrical manifold, and wherein the arcuate wall section is defined by an outer arcuate surface radially spaced apart from the cylindrical inner surface.

2. The header of claim 1, further comprising a plug inserted into an opening extending through the planar outer surface to the aperture, wherein the plug includes an insertion portion with a first closed surface partially defining the aperture.

3. The header of claim 2, wherein a flange portion of the plug is brazed to the planar outer surface, wherein the flange portion surrounds the insertion portion, and wherein the insertion portion extends parallel to the first direction beyond the flange portion.

4. The header of claim 2, further comprising a mounting pin integral with the plug and extending outwardly from a flange portion in the first direction, wherein the mounting pin is located in the center of the plug and is surrounded by the flange portion, and wherein the mounting pin extends parallel to the first direction and is in-line with the intersection.

5. The header of claim 2, wherein the arcuate wall sections of the first and second cylindrical fluid manifolds define a minimum wall thickness of the header, and wherein the insertion depth of the insertion portion through the opening is approximately equal to the minimum wall thickness, and wherein a height dimension of the insertion portion between the closed surface and the flange portion is approximately equal to the minimum wall thickness.

6. The header of claim 1 wherein the thickened wall section is a first thickened wall section, further comprising:

a third cylindrical fluid manifold extending parallel to the first and second cylindrical fluid manifolds having a plurality of third tube slots extending through a third arcuate wall section of the arcuate wall section;

a second thickened wall section bounded by the third cylindrical fluid manifold, the second cylindrical fluid manifold, and the planar outer surface of the header, the second thickened wall section having a generally triangular cross-section; and a second arcuate intersection between the second arcuate wall section and the third arcuate wall section, wherein the planar outer surface extends from the first cylindrical manifold to the third cylindrical manifold, and wherein the second arcuate intersection is located opposite the second thickened wall section along another direction parallel to the first direction.

7. The header of claim 6, wherein the aperture is a first aperture, further comprising a second aperture extending through the second thickened wall section to provide another fluid communication pathway between the third and second cylindrical fluid manifolds.

8. The header of claim 6, further comprising:

a first mounting flange extending from the header and defining a first mounting plane;

a first mounting hole extending through the first mounting flange;

a second mounting flange extending from the header and defining a second mounting plane parallel to the first mounting plane; and a second mounting hole extending through the second mourning flange and aligned with the first mounting hole, wherein the first and second mounting planes are oriented perpendicular to the planar outer surface of the header, and wherein the first mounting hole and the second mounting hole are both spaced apart from the planar outer surface of the header in the first direction to accommodate a straight bolt with a clear, straight path from the first mounting hole to the second mounting hole.

9. The header of claim 8, wherein the first, second, and third fluid manifolds are entirely located between the first and second mounting planes.

10. A header for a heat exchanger, comprising:

a plurality of parallel arranged cylindrical fluid manifolds;

a plurality of arcuate wall sections having a generally constant wall thickness, each of the arcuate wall sections corresponding to one of the plurality of cylindrical fluid manifolds and each having a plurality of tube slots extending through the generally constant wall thickness to the corresponding fluid manifold;

a planar outer surface extending across the plurality of parallel arranged cylindrical fluid manifolds and located on an opposite side of the plurality of parallel arranged cylindrical fluid manifolds from the plurality of arcuate walls sections;

one or more thickened wall sections bounded by two adjacent ones of the plurality of cylindrical fluid manifolds and a planar outer surface of the header, the one or more thickened sections each having a generally triangular cross-section; and one or more apertures extending through the one or more thickened wall sections to provide a fluid communication pathway between those cylindrical fluid manifolds hounding the one or more thickened wall sections, Wherein each of the plurality of arcuate walls sections includes an outer arcuate surface and an inner cylindrical surface, wherein the outer arcuate surface and the inner cylindrical surface are radially spaced apart to define a minimum wall thickness, and wherein each of the ore or more apertures is defined by a first planar top surface, a second planar bottom surface, and a first and second arcuate side edges that each extend from the first planar top surface to the second planar bottom surface wherein as a height dimension of the aperture, which is parallel to a first direction perpendicular to the planar outer surface, increases, the aperture becomes progressively longer in a second direction parallel to the planar outer surface starting from the second planar bottom surface and ending at the first planar top surface.

11. The header of claim 10, further comprising one or more plugs in one-to-one correspondence with the one or more apertures, each plug inserted into an opening extending through the planar outer surface to the corresponding aperture, wherein each of the one or more plugs includes an insertion portion having closed bottom surface, wherein the closed bottom surface defines the first planar top surface of the one or more apertures, and wherein the insertion portion extends from the first arcuate side edge to the second arcuate side edge.

12. The header of claim 11, wherein at least some of said plugs includes a mounting pin integral with the plug and extending outwardly from a thicker central region of the plug in a direction perpendicular to the planar outer surface, wherein the plug includes a thinner flange portion surrounding the thicker central region, wherein the plugs are located down a line running the length of the header, and wherein the line is parallel to a longitudinal axis of the header that bisects header.

13. The header of claim 10, further comprising:

first mounting flange extending from the header and defining a first mounting plane;

a first mounting hole extending through the first mounting flange;

a second mounting flange extending from the header and defining a second mounting plane parallel to the first mounting plane; and a second mounting hole extending through the second mounting flange and aligned with the first mounting hole, wherein the first and second mounting planes are oriented perpendicular to the planar outer surface of the header, wherein the first mounting hole and the second mounting hole are both spaced apart from the planar outer surface of the header in a direction perpendicular to the planar outer surface to accommodate a straight bolt with a clear, straight path from the first mounting hole to the second mounting hole.

14. The header of claim 13, wherein the plurality of parallel arranged cylindrical fluid manifolds is entirely located between the first and second mounting planes.

15. A method of making a header for a heat exchanger, comprising:

providing an extruded section having two unconnected cylindrical volumes therein and having a planar outer surface;

machining a round hole through the planar outer surface removing a thickened wall section to define an aperture between the two cylindrical volumes; and inserting a plug into an opening created in the planar outer surface by the step of machining through the planar outer surface to define the aperture, wherein the removed thickened wall section has a generally triangular cross-section, and wherein a maximum height dimension of the aperture in a first direction perpendicular to the planar outer surface depends on a width dimension of the round hole in a second direction parallel to the planar outer surface.

16. The method of claim 15, wherein the plug is brazed to the extruded section to secure the plug in the opening.

17. The method of claim 15, wherein the step of machining through the planar outer surface includes removing material of the extruded section to a depth, as measure from the planar outer surface, that is approximately equal to the radius of at least one of the two cylindrical volumes.

18. The method of claim 15, further comprising forming a series of tube slots in arcuate wall sections of the two cylindrical volumes opposite the planar outer surface.

19. The method of claim 15, wherein an apex of the triangular cross-section is located on an opposite side of a middle axis of a cross-section of the header from the planar outer surface.

* * * * *